US010207314B2

(12) United States Patent
Bochiechio et al.

(10) Patent No.: US 10,207,314 B2
(45) Date of Patent: Feb. 19, 2019

(54) INVESTMENT MOLD WITH FUGITIVE BEADS AND METHOD RELATED THERETO

(71) Applicant: United Technologies Corporation, Hartford, CT (US)

(72) Inventors: Mario Bochiechio, Vernon, CT (US); Charles R. Watson, Windsor, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 84 days.

(21) Appl. No.: 14/768,256

(22) PCT Filed: Jan. 27, 2014

(86) PCT No.: PCT/US2014/013159
§ 371 (c)(1),
(2) Date: Aug. 17, 2015

(87) PCT Pub. No.: WO2014/130212
PCT Pub. Date: Aug. 28, 2014

(65) Prior Publication Data

US 2016/0001353 A1 Jan. 7, 2016

Related U.S. Application Data

(60) Provisional application No. 61/766,236, filed on Feb. 19, 2013.

(51) Int. Cl.
*B22C 1/08* (2006.01)
*B22C 1/02* (2006.01)
(Continued)

(52) U.S. Cl.
CPC ..... *B22C 1/08* (2013.01); *B22C 1/02* (2013.01); *B22C 9/02* (2013.01); *B22C 9/04* (2013.01); *B22C 9/22* (2013.01)

(58) Field of Classification Search
CPC .... B22C 1/02; B22C 1/08; B22C 9/02; B22C 9/04; B22C 9/22
See application file for complete search history.

(56) References Cited

U.S. PATENT DOCUMENTS 3,362,463 A * 1/1968 Manginelli ..... B22C 9/04 164/34
3,367,393 A * 2/1968 Lenahan ..... B22C 1/165 164/34
(Continued)

FOREIGN PATENT DOCUMENTS

EP 0049486 9/1985
EP 0499486 8/1992
(Continued)

OTHER PUBLICATIONS

International Preliminary Report on Patentability for PCT Application No. PCT/US2014/013159 dated Sep. 3, 2015.
(Continued)

*Primary Examiner* — Kevin E Yoon
*Assistant Examiner* — Jacky Yuen
(74) *Attorney, Agent, or Firm* — Carlson, Gaskey & Olds, P.C.

(57) ABSTRACT

An investment mold includes a mold cavity and a refractory investment wall that bounds at least a portion of the mold cavity. At least a portion of the refractory investment wall includes a plurality of fugitive beads. The fugitive beads can be sacrificed to provide voids that control the strength of the refractory investment wall such that the wall fractures at the voids during investment casting to alleviate stress on a solidified metal cast in the mold cavity.

22 Claims, 4 Drawing Sheets

(51) Int. Cl.

| | |
|---|---|
| ***B22C 9/04*** | (2006.01) |
| ***B22C 9/02*** | (2006.01) |
| ***B22C 9/22*** | (2006.01) |

(56) References Cited

U.S. PATENT DOCUMENTS

| | | | | | |
|---|---|---|---|---|---|
| 4,711,288 | A | | 12/1987 | Harvey | |
| 5,297,615 | A | * | 3/1994 | Aimone | B22C 9/04 164/361 |
| 5,662,160 | A | * | 9/1997 | Correia | B22C 7/02 164/35 |
| 5,746,272 | A | | 5/1998 | Mastrorio et al. | |
| 8,235,092 | B2 | | 8/2012 | Scott | |
| 2006/0225857 | A1 | | 10/2006 | Ward et al. | |
| 2011/0114279 | A1 | * | 5/2011 | Scott | B22C 7/02 164/24 |
| 2011/0132562 | A1 | * | 6/2011 | Merrill | B22C 9/02 164/9 |

FOREIGN PATENT DOCUMENTS

| | | | | | |
|---|---|---|---|---|---|
| EP | 0502580 | A1 | * | 9/1992 | B22C 1/165 |
| EP | 0914883 | | | 5/1999 | |
| EP | 1016639 | | | 7/2000 | |
| EP | 1381481 | | | 1/2004 | |
| EP | 1862482 | A1 | * | 12/2007 | C04B 35/195 |

OTHER PUBLICATIONS

The International Search Report and Written Opinion for PCT Application No. PCT/US2014/013159, dated May 9, 2014.

* cited by examiner

INVESTMENT MOLD WITH FUGITIVE BEADS AND METHOD RELATED THERETO

BACKGROUND

This disclosure relates to investment casting. Investment casting is known and used to cast metallic components with relatively complex geometries. For example, gas turbine engine components, such as airfoils, are fabricated by investment casting. For cast components that have internal passages, the internal passages can be formed using a core that represents a positive projection of negative features that are to be formed in the casting process. A wax pattern is provided around the core in the geometry of the component to be cast. A refractory shell is formed around the wax pattern and the wax is then removed to form a mold cavity between the core and the shell. Molten metal is poured into the cavity. After solidification of the metal, the shell and core are removed using known techniques to release the cast component.

SUMMARY

An investment mold according to an exemplary aspect of the present disclosure includes a mold cavity and a refractory investment wall which bounds at least a portion of the mold cavity, and at least a portion of the refractory investment wall includes a plurality of fugitive beads.

In a further non-limiting embodiment of any of the foregoing examples, the plurality of fugitive beads includes mechanically fugitive beads.

In a further non-limiting embodiment of any of the foregoing examples, the mechanically fugitive beads are hollow beads.

In a further non-limiting embodiment of any of the foregoing examples, the hollow beads are hollow silica beads.

In a further non-limiting embodiment of any of the foregoing examples, the hollow beads have a nominal wall thickness of 25.4 micrometers.

In a further non-limiting embodiment of any of the foregoing examples, the fugitive beads include thermally fugitive beads.

In a further non-limiting embodiment of any of the foregoing examples, the thermally fugitive beads are solid beads.

In a further non-limiting embodiment of any of the foregoing examples, the solid beads are organic.

In a further non-limiting embodiment of any of the foregoing examples, the fugitive beads are macrobeads.

In a further non-limiting embodiment of any of the foregoing examples, the fugitive beads are microbeads.

In a further non-limiting embodiment of any of the foregoing examples, the refractory investment wall is multi-layered.

In a further non-limiting embodiment of any of the foregoing examples, the fugitive beads are non-uniformly dispersed in the refractory investment wall.

A method of controlling strength of an investment mold according to an exemplary aspect of the present disclosure includes a controlling strength of a refractory investment wall which bounds at least a portion of a mold cavity by incorporating a plurality of fugitive beads in at least a portion of the refractory investment wall.

A further non-limiting embodiment of any of the foregoing examples includes thermally or mechanically sacrificing the plurality of fugitive beads such that the plurality of fugitive beads leave voids in the refractory investment wall.

A further non-limiting embodiment of any of the foregoing examples includes incorporating the plurality of fugitive beads in high-stress portions of the refractory investment wall, while other, low-stress portions of the refractory investment wall are free of any of the plurality of fugitive beads.

A further non-limiting embodiment of any of the foregoing examples includes incorporating the plurality of fugitive beads into a multi-layer structure of the refractory investment wall.

A further non-limiting embodiment of any of the foregoing examples includes incorporating the plurality of fugitive beads in a non-uniform dispersion in the refractory investment wall.

A further non-limiting embodiment of any of the foregoing examples includes incorporating the plurality of fugitive beads using a blend of the plurality of fugitive beads with a dry refractory material.

A further non-limiting embodiment of any of the foregoing examples includes incorporating the plurality of fugitive beads using a slurry of plurality of fugitive beads with a refractory material.

A method of investment casting according to an exemplary aspect of the present disclosure includes providing a molten metal into a mold cavity of an investment mold which has a refractory investment wall bounding at least a portion of the mold cavity, and at least a portion of the refractory investment wall includes a plurality of fugitive beads, sacrificing the plurality of fugitive beads to provide voids in the refractory investment wall, and solidifying the molten metal in the cavity. The solidifying produces a stress on the refractory investment wall such that the refractory investment wall fractures at the voids to alleviate stress on the solidified metal.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
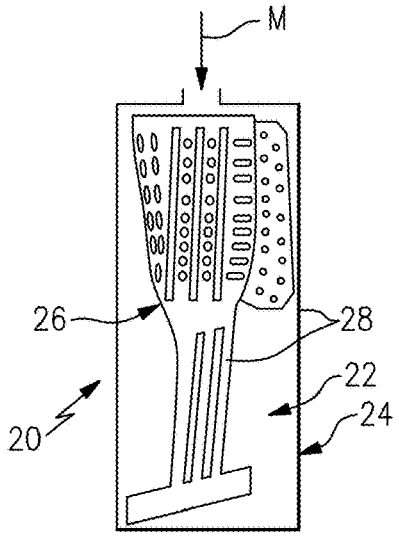
FIG. 1 illustrates an example investment mold.

FIG. 1 schematically illustrates selected portions of an example investment mold 20. In this example, the investment mold 20 is configured for casting a gas turbine engine component, such as an airfoil. It is to be understood however, that the investment mold 20 is not limited to airfoils or gas turbine engine components and the examples herein will also benefit other kinds of cast components and components that are subject to hot tearing or cracking during molten metal solidification and cool down to room temperature during the casting process.

In this example, the investment mold 20 includes a mold cavity 22 that is generally surrounded by a refractory shell 24 (hereafter "shell 24"). A refractory core 26 (hereafter "core 26") is situated within the mold cavity 22 and serves to form internal passages in the cast component. The shell 24 and the core 26 include refractory investment walls 28 that bound and define the mold cavity 22. As can be appreciated, some components may not have internal passages and may therefore not utilize the core 26. For example, the term "refractory" refers to a material that retains good strength at high temperatures (see also ASTM Volume 15.01 Refractories; Activated Carbon, Advanced Ceramics), such as above a temperature of 1,000° F. (811 K; 538° C.). For example, the refractory investment walls 28 are walls that, in the cast-ready state include, by weight, a total composition having a predominant amount of refractory material or materials, and in some examples 75% or greater, or 90% or greater, by weight of refractory material or materials. As can be further appreciated, the refractory investment walls 28 can be uni- or multi-layered.

Figure 2:
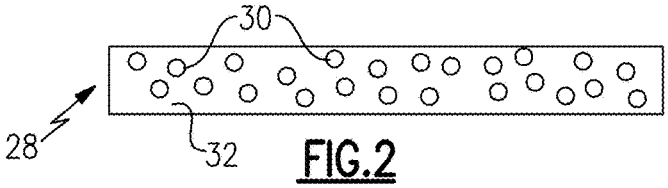
FIG. 2 illustrates a portion of a refractory investment wall of the investment mold of FIG. 1.

FIG. 2 illustrates a portion of one of the refractory investment walls 28, which can be in the refractory shell 24, the refractory core 26 or both. The refractory investment wall 28 includes a plurality of fugitive beads 30. The fugitive beads 30 are spherical and are at least mechanically bonded with a refractory material 32. As an example, the refractory material 32 includes a ceramic material, as is known and used in the formation of investment mold shells and cores. As will be described herein, the fugitive beads 30 are sacrificed during the casting process to leave voids in the refractory investment wall 28. The voids reduce the strength of the refractory investment wall 28 such that during the casting the refractory investment wall 28 can more easily fracture to alleviate stress on the cast component as it solidifies and cools. Moreover, the composition, size and amount of the fugitive beads 30 used can be readily controlled to provide enhanced control over the structure, properties and behavior of the refractory investment wall 28. As a comparison, sawdust can be incorporated to weaken a shell, but the composition, particle size, and properties of sawdust can vary by source and thus cause variation in the behavior and properties of the shell.

The fugitive beads 30 can be thermally fugitive, mechanically fugitive or a combination of thermally and mechanically fugitive beads with respect to how the beads 30 are sacrificed. The term "fugitive" refers to a bead that is configured, by composition or physical structure or a combination thereof, to provide a non-reinforced or substantially non-reinforced void in the refractory investment wall 28 in response to the casting process. Thermally fugitive beads are sacrificed by thermal conversion from a solid to a liquid or a gas in the casting process. In the liquid or gaseous state, the bead material is unable to reinforce the void and the bead therefore ceases to act as a reinforcement filler. Mechanically fugitive beads are sacrificed by induced mechanical stress on the bead during the casting process such that the bead fractures, implodes, crushes or otherwise changes in physical structure such that the bead is unable to reinforce the void, or reduces the level of reinforcement, and the bead therefore ceases to act as a reinforcement filler. The following are further examples of thermally and mechanically fugitive beads.

Figure 3:
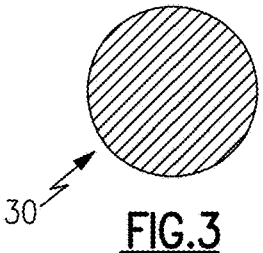
FIG. 3 illustrates an example thermally fugitive, solid bead that can be used in the refractory investment wall of FIG. 2.

FIG. 3 shows a cross-section of a representative one of the fugitive beads 30. In this example, the fugitive bead 30 is a thermally fugitive, solid bead that has an organic composition. During the casting process, the refractory investment wall 28 is exposed to temperatures that can exceed a melting temperature or a decomposition temperature of the organic material. As the organic material melts or decomposes, the fugitive bead 30 is sacrificed to produce an unreinforced void in the refractory investment wall 28 that reduces strength of the refractory investment wall 28.

In further examples, the organic composition is a phenolic material or other thermoset polymer material, an acrylic material, a polyethylene or other thermoplastic polymer material, a paraffin material, a stearate material or a combination thereof. The bead size, amount and composition of the thermally fugitive, solid beads can also be tailored to provide a desirable strength and response in the refractory investment wall 28. For example, molecular weight of the organic composition can be varied to influence the melt or decomposition temperature of the fugitive bead 30.

Figure 4:
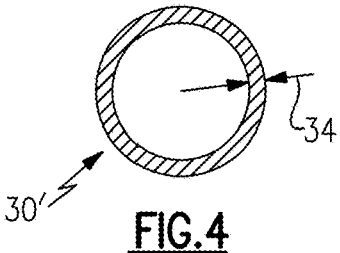
FIG. 4 illustrates an example mechanically fugitive, hollow bead that can be used in the refractory investment wall of FIG. 2.

FIG. 4 shows a cross-section of a representative one of another example fugitive bead 30' that can alternatively or additionally be used in the refractory investment wall 28. In this example, the fugitive bead 30' is a mechanically fugitive, hollow bead that is formed of an inorganic material, such as a glass or ceramic material. In one example, the hollow bead is a silica sphere having a nominal wall thickness of 0.001 inches (25.4 micrometers), as represented at 34. In a further example, the composition and the nominal wall thickness 34 of the fugitive bead 30' are selected such that the strength of the fugitive bead 30' is below the induced stress of the casting process. The fugitive bead 30' thus fractures during the casting process. As a further example, silica is weaker than many other inorganic materials and thus serves as a good material for the fugitive bead 30'. Similarly, a relatively thin nominal wall thickness 34 permits the fugitive bead 30' to fracture, while thicker bead walls strengthen the fugitive bead 30'.

During the investment casting process, a molten metal M (FIG. 1) is poured into the mold cavity 22. The composition of the molten metal can be selected according to the type of component being fabricated. In the example of gas turbine engine components, such as airfoils, the metal can be a superalloy, such as a nickel-based alloy. Alternatively, the metal can be an aluminum-based alloy, a copper-based alloy, a cobalt based alloy or an iron-based alloy. However, this disclosure is not limited to any particular metal composition.

Figure 5B:
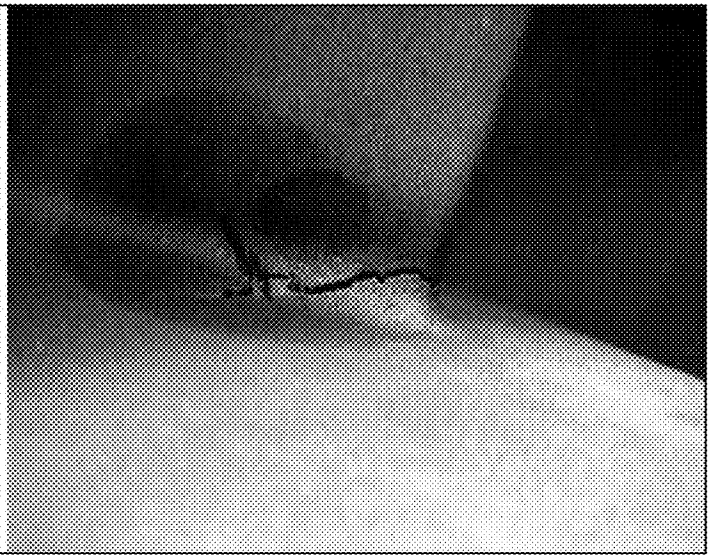
FIG. 5B illustrates a macroscopic view of the crack of FIG. 5A.
Figure 5A:
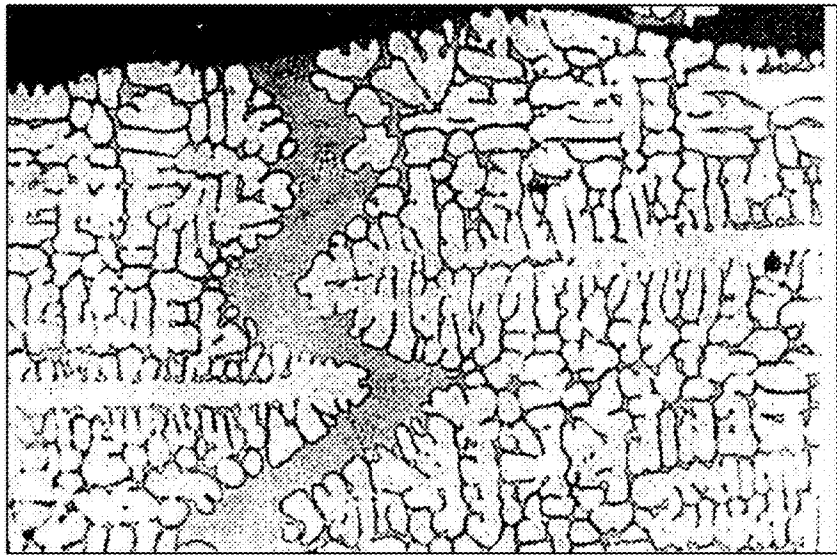
FIG. 5A illustrates a micrograph of a crack extending between dendrites in a microstructure.

After pouring, the investment mold 20 is then cooled to solidify the molten metal. In one example, the investment mold 20 is cooled such that the resulting component has an equiaxed microstructure, although this disclosure is not limited to such microstructures. Upon solidification and cooling, the metal shrinks. The shell 24 and core 26 can restrain the shrinkage and thus induce stresses on the shell 24, the core 26 and the cast component. If a shell and core are exceedingly stiff and strong, a relatively high stress can be induced on the cast component during cooling, resulting in hot tearing and/or cracking, as shown in FIGS. 5A and 5B. The use of the fugitive beads 30/30' and the resulting voids in the refractory investment walls 28 weaken the shell 24 and/or the core 26 such that the refractory investment walls 28 can fracture at locations of high induced stresses and thus alleviate stresses on the cast component to reduce the possibility of tearing and/or cracking.

Additionally, the size, amount and location of the fugitive beads 30/30' can be tailored according to an investment casting process. For example, the size and amount of the fugitive beads 30/30' can be controlled to reduce the strength of the refractory investment wall 28 below a level at which a target generated stress level cause fracture of the refractory investment wall. As an example, the fugitive beads 30/30' are macro-sized and thus have a diameter or maximum dimension of one millimeter or greater. Alternatively, the fugitive beads 30/30' are micro-sized and have a diameter or maximum dimension of no greater than 0.250 millimeters. In further examples, the fugitive beads 30/30' have a diameter or maximum dimension of 0.125-0.250 millimeters, 0.063 millimeters, 0.053 millimeters, 0.044 millimeters, 0.037 millimeters or combinations thereof. For small components, the smaller size can be used and for larger components the larger sizes can be used. The amount, by volume, of the fugitive beads 30/30' in a particular location can also be varied to control strength. For example, the amount by volume is 10-90%.

Alternatively, or in addition to controlling the size and amount of the fugitive beads 30/30', the location of the fugitive beads 30/30' in the refractory investment wall 28 can be tailored to a particular investment casting process. For example, the fugitive beads 30/30' can be incorporated in high-stress locations of the refractory investment wall 28, where there is higher possibility that the high stresses will cause hot tearing and/or cracking of the cast component. Relatively low-stress locations have less of the fugitive beads 30/30' or are free of any of the fugitive beads 30/30'. Locations in the refractory investment wall 28 that are free of fugitive beads 30/30' have no fugitive beads 30/30' dispersed therein. In one example, a high-stress location is a location adjacent a fillet of an airfoil component, where an airfoil meets another structure of the component, such as a platform.

Figure 6:
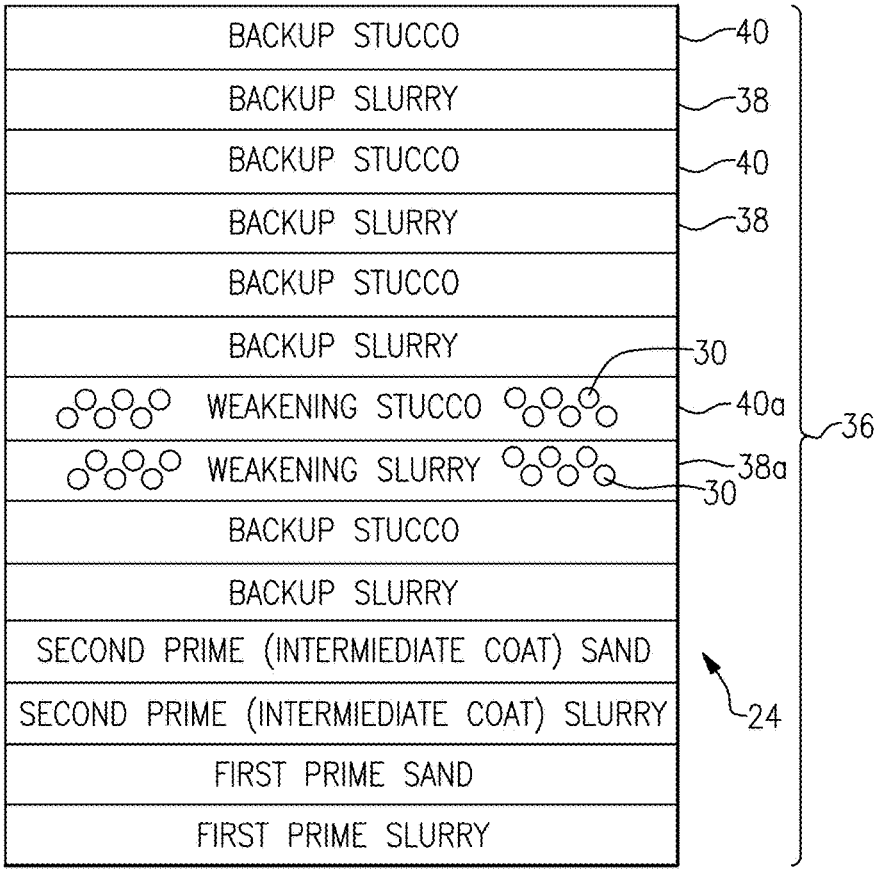
FIG. 6 illustrates an example multi-layer structure of a refractory investment wall.

The fugitive beads 30 can be incorporated into the refractory investment wall 28 during fabrication of the refractory investment wall 28. For example, the refractory investment wall 28 of the shell 24 can be a multi-layer structure 36, as shown in FIG. 6. In this example, the multi-layer structure 36 is a stucco material that has alternating layers of refractory material 38 that is formed from a slurry and dry layers of stucco material 40. For example, the refractory material is or includes alumina and stucco material 40 can be silica, sand or other refractory ceramic.

In the process of fabricating the multi-layer structure 36, a slurry is applied onto a wax pattern, for example. The dry stucco 40 is then applied onto the wet slurry and then subjected to a drying process to remove a carrier fluid from the slurry. The process can be repeated for a desired number of cycles to build-up a desired number of alternating layers of refractory material 38 and stucco material 40. The fugitive beads 30/30' can be incorporated into the slurry, the stucco material 40 or both in order to incorporate the fugitive beads 30/30' in the refractory investment wall 28.

Figure 7:
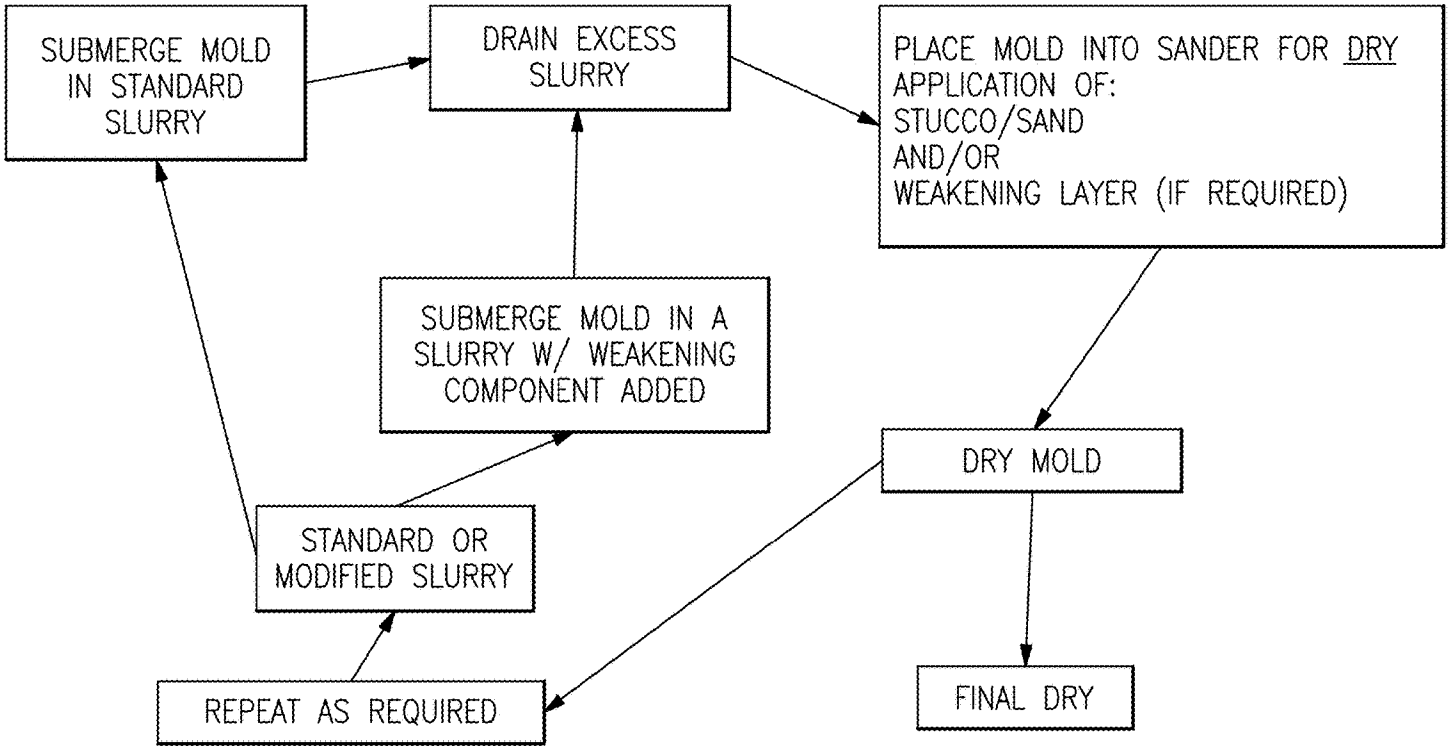
FIG. 7 illustrates a flow chart of an example process for making the structure shown in FIG. 6

In the illustrated example, the fugitive beads 30/30' are applied instead of or in addition to one or more of the layers of stucco material 40. As shown for example in FIG. 6, the multi-layer structure 36 includes a modified refractory material layer **38*a* and a modified stucco material layer 40*a* that each include the fugitive beads 30, although the fugitive beads 30' could alternatively be used. The fugitive beads 30/30' can be applied manually, automatically using a machine or semi-automatically by an operator using a machine. In one example, the fugitive beads 30/30' are applied in a blend with the stucco material 40. Alternatively, or in addition to replacing or using the fugitive beads with the stucco material 40, the fugitive beads 30 can be mixed into the slurry and applied in a wet form to the wax pattern to form one or more of the layers 38. FIG. 7 schematically illustrates a flow chart of an example process for making the structure shown in FIG. 6**.

Figure 8:
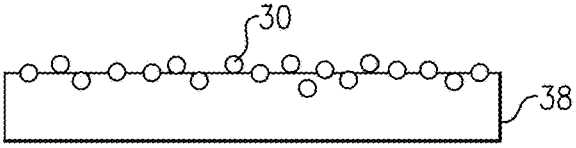
FIG. 8 illustrates an example application of fugitive beads to a wet slurry layer used to fabricate a refractory investment wall.

FIG. 8 shows one of the layers of the multi-layer structure 36 fabricated from the slurry and the refractory material 38. In this example, dry fugitive beads 30 (alternatively fugitive beads 30') have been applied to the top surface of the wet slurry layer. The fugitive beads 30 are generally suspended near the top of the wet slurry layer, although some of the fugitive beads 30 can sink slightly into the surface. The fugitive beads 30 thus remain near or at the top surface of the wet slurry layer, rather than sinking completely into and being completely embedded in the wet slurry layer. Upon drying, the fugitive beads 30 are thus concentrated near the upper surface of the layer of the refractory material 38. Subsequent layers of the wet slurry, the stucco material and additional fugitive beads 30/30' can be applied as desired.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An investment mold comprising:

a mold cavity; and a refractory investment wall bounding at least a portion of the mold cavity, at least a portion of the refractory investment wall including one or more layers comprising a plurality of fugitive beads, wherein the plurality of fugitive beads is non-uniformly dispersed in the one or more layers of the refractory investment wall, and a concentration of the fugitive beads is greater in the one or more layers of a first portion of the refractory investment wall than in the same layers of a second portion of the refractory investment wall, wherein the first portion is subjected to higher stresses during an investment casting process than the second portion.

2. The investment mold as recited in claim 1, wherein the plurality of fugitive beads include mechanically fugitive beads.

3. The investment mold as recited in claim 2, wherein the mechanically fugitive beads are hollow beads.

4. The investment mold as recited in claim 3, wherein the hollow beads are hollow silica beads.

5. The investment mold as recited in claim 4, wherein the hollow beads have a nominal wall thickness of 25.4 micrometers.

6. The investment mold as recited in claim 1, wherein the plurality of fugitive beads include thermally fugitive beads.

7. The investment mold as recited in claim 6, wherein the thermally fugitive beads are solid beads.

8. The investment mold as recited in claim 7, wherein the solid beads are organic.

9. The investment mold as recited in claim 1, wherein the plurality of fugitive beads are macrobeads.

10. The investment mold as recited in claim 1, wherein the plurality of fugitive beads are microbeads.

11. The investment mold as recited in claim 1, wherein the refractory investment wall is multi-layered.

12. The investment mold as recited in claim 1, wherein the second portion of the refractory investment wall is free of the fugitive beads.

13. The investment mold as recited in claim 1, wherein the mold cavity conforms to the shape of an airfoil component, and the first portion of the refractory investment wall is adjacent a fillet portion of the airfoil component where the airfoil component meets a platform.

14. The investment mold as recited in claim 11, wherein the one or more layers comprise a plurality of layers that are intermediate layers of the refractory investment wall and are adjacent to each other, the plurality of fugitive beads provided in the plurality of layers.

15. A method of controlling strength of an investment mold, the method comprising:

controlling strength of a refractory investment wall bounding at least a portion of a mold cavity by incorporating a plurality of fugitive beads in at least a portion of the refractory investment wall, such that a concentration of the fugitive beads is greater in one or more layers of a first portion of the mold cavity than in the same layers of a second portion of the mold cavity, wherein the first portion is subjected to higher stresses during an investment casting process than the second portion.

16. The method as recited in claim 15, including thermally or mechanically sacrificing the plurality of fugitive beads such that the plurality of fugitive beads leave voids in the refractory investment wall.

17. The method as recited in claim 15, wherein the second portion is one of a plurality of second portions of the refractory investment wall, each of which are free of any of the plurality of fugitive beads, and each of which are subjected to lower stresses during an investment casting process than the first portion.

18. The method as recited in claim 15, including incorporating the plurality of fugitive beads into a multi-layer structure of the refractory investment wall.

19. The method as recited in claim 15, including incorporating the plurality of fugitive beads in a non-uniform dispersion in the one or more layers of the refractory investment wall.

20. The method as recited in claim 15, including incorporating the plurality of fugitive beads using a blend of the plurality of fugitive beads with a dry refractory material.

21. The method as recited in claim 15, including incorporating the plurality of fugitive beads using a slurry of plurality of fugitive beads with a refractory material.

22. A method of investment casting, the method comprising:

providing a molten metal into a mold cavity of an investment mold having a refractory investment wall bounding at least a portion of the mold cavity, at least a portion of the refractory investment wall including a plurality of fugitive beads in one or more layers, wherein a concentration of the fugitive beads is greater in the one or more layers of a first portion of the refractory investment wall than in the same layers of a second portion of the refractory investment wall, wherein the first portion is subjected to higher stresses during the investment casting than the second portion;

sacrificing the plurality of fugitive beads to provide voids in the refractory investment wall; and solidifying the molten metal in the cavity, the solidifying producing a stress on the refractory investment wall such that the refractory investment wall fractures at the voids to alleviate stress on the solidified metal.

* * * * *